US007263943B2

(12) United States Patent
Takada et al.

(10) Patent No.: US 7,263,943 B2
(45) Date of Patent: Sep. 4, 2007

(54) OUTBOARD MOTOR STEERING SYSTEM

(75) Inventors: Hideaki Takada, Saitama (JP); Hiroshi Watabe, Saitama (JP); Taiichi Otobe, Saitama (JP); Hiroshi Mizuguchi, Saitama (JP); Yoshinori Masubuchi, Saitama (JP); Shinsaku Nakayama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 203 days.

(21) Appl. No.: 11/118,948

(22) Filed: Apr. 29, 2005

(65) Prior Publication Data

US 2005/0241556 A1 Nov. 3, 2005

(30) Foreign Application Priority Data

Apr. 30, 2004 (JP) ..... 2004-136127

(51) Int. Cl.
*B63H 25/04* (2006.01)
*A01B 69/00* (2006.01)

(52) U.S. Cl. ..... 114/144 E; 701/41

(58) Field of Classification Search ..... 114/144 E
See application file for complete search history.

(56) References Cited

U.S. PATENT DOCUMENTS 4,771,846 A * 9/1988 Venable et al. ..... 180/422
6,678,596 B2 * 1/2004 Husain et al. ..... 701/41
6,843,195 B2 * 1/2005 Watabe et al. ..... 114/144 E

FOREIGN PATENT DOCUMENTS

JP 2002-187597 7/2002

* cited by examiner

*Primary Examiner*—Jesús D. Sotelo
(74) *Attorney, Agent, or Firm*—Carrier, Blackman & Associates, P.C.; William D. Blackman; Joseph P. Carrier

(57) ABSTRACT

In a boat having a seat, a steering wheel, and an outboard motor, an outboard motor steering system is provided, where the steering wheel is installed near the seat a steering angle sensor installed near the steering wheel for outputting a signal indicative of a steering angle of the steering wheel. The steering system also includes a swivel shaft connected to a propeller to turn the propeller relative to the boat, and an electric motor connected to the swivel shaft for rotating the swivel shaft in response to the detected steering angle. The steering system also includes a manipulation load regulation mechanism, such as a hydraulic damper, to produce an added load for increasing a manipulation load of the steering wheel, thereby enabling reduced operator load by using the electric motor to steer the outboard motor, while improving the operator's feel of steering wheel manipulation.

15 Claims, 13 Drawing Sheets

OUTBOARD MOTOR STEERING SYSTEM

CROSS-REFERENCE TO RELATED APPLICATION

This application claims priority under 35 U.S.C. §119 from Japanese Patent Application No. 2004-136127 filed on Apr. 30, 2004, the entire disclosure of which is hereby incorporated by reference.

BACKGROUND OF THE INVENTION

1. Field of the Invention

This invention relates to an outboard motor steering system.

2. Description of the Related Art

In recent years, technologies have been developed that reduce the burden on the operator of an outboard motor driven boat by enabling steering of the outboard motor using an actuator connected to the motor. Steering systems of this type generally use a sensor to detect the steering angle of a steering wheel provided on the hull (boat) and drive the steering actuator based on the detected value, as taught, for example, in Japanese Laid-Open Patent Application No. 2002-187597, paragraphs 0011, 0025 and 0027 and FIG. 1.

Such a prior art steering system that steers an outboard motor using an actuator completely cut off mechanical interconnection between the steering wheel and the outboard motor. This results in such an excessive reduction in steering wheel manipulation load that the operator may be dissatisfied with the operating feel.

SUMMARY OF THE INVENTION

An object of the invention is therefore to overcome the foregoing drawback by providing an outboard motor steering system that reduces operator load by using an actuator to steer an outboard motor and improves the feel of steering wheel manipulation.

In order to achieve the object, in a first embodiment thereof, the present invention provides a steering system for an outboard motor, mounted on a stem of a boat and having an internal combustion engine and a propeller with a rudder powered by the engine to propel and steer the boat. The steering system includes a steering wheel installed near a seat of an operator of the boat to be manipulated by the operator; a steering angle sensor, installed near the steering wheel for outputting a signal indicative of a steering angle of the steering wheel; and a swivel shaft connected to the propeller to turn the propeller relative to the boat. The steering system also includes an actuator connected to the swivel shaft for rotating the swivel shaft in response to the detected steering angle; and a manipulation load regulation mechanism capable of producing an added load for increasing a manipulation load experienced at the steering wheel to regulate the manipulation load of the operator.

BRIEF DESCRIPTION OF THE DRAWINGS

The above and other objects and advantages of the invention will be more apparent from the following description and drawings in which.

DETAILED DESCRIPTION OF ILLUSTRATIVE EMBODIMENTS

Here follows a description of selected illustrative embodiments of an outboard motor steering system according to the invention made with reference to the appended drawings.

Figure 1:
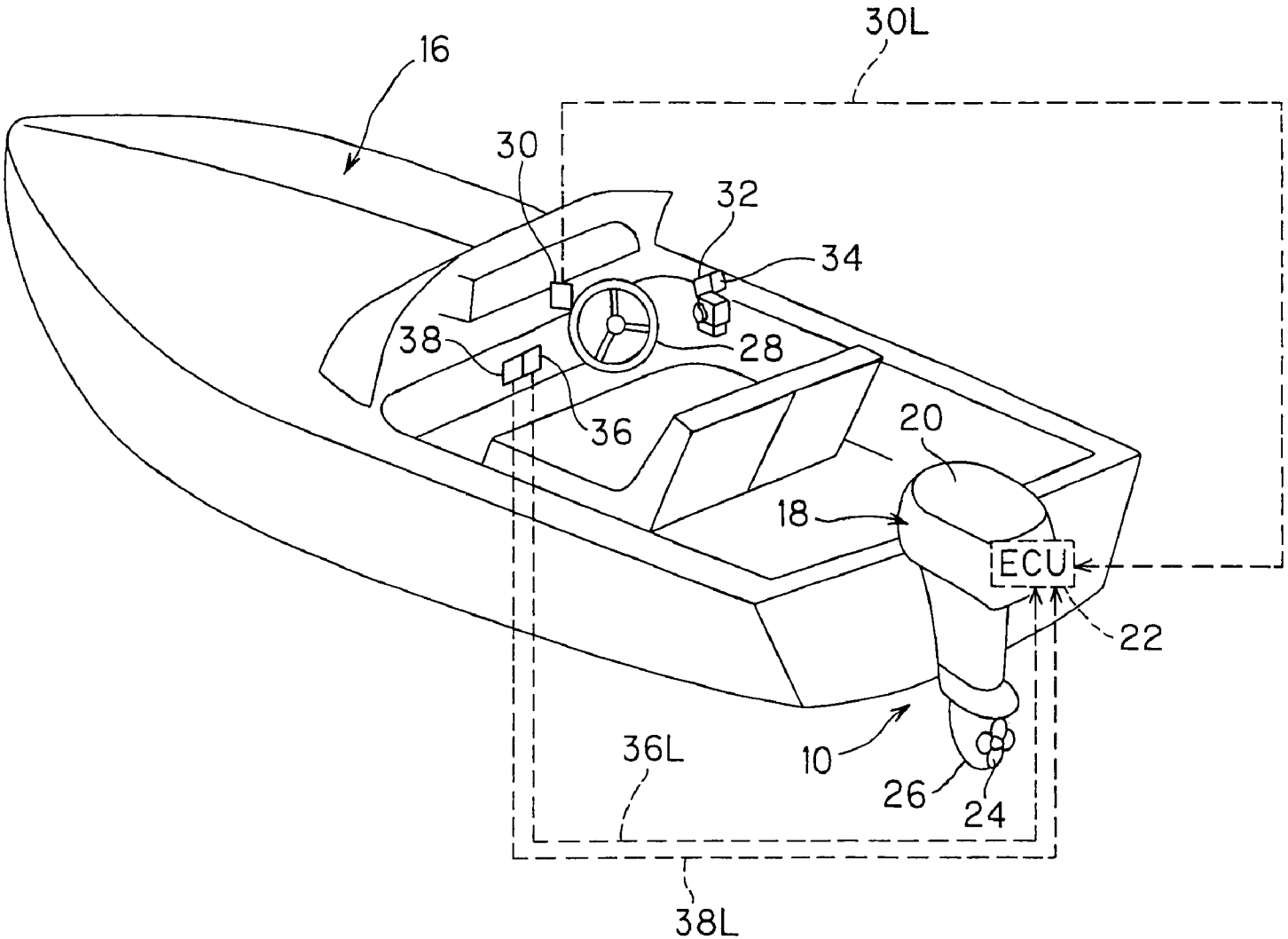
FIG. 1 is an overall schematic view of a boat incorporating an outboard motor steering system according to a first embodiment of the invention, with primary focus on the outboard motor.
Figure 2:
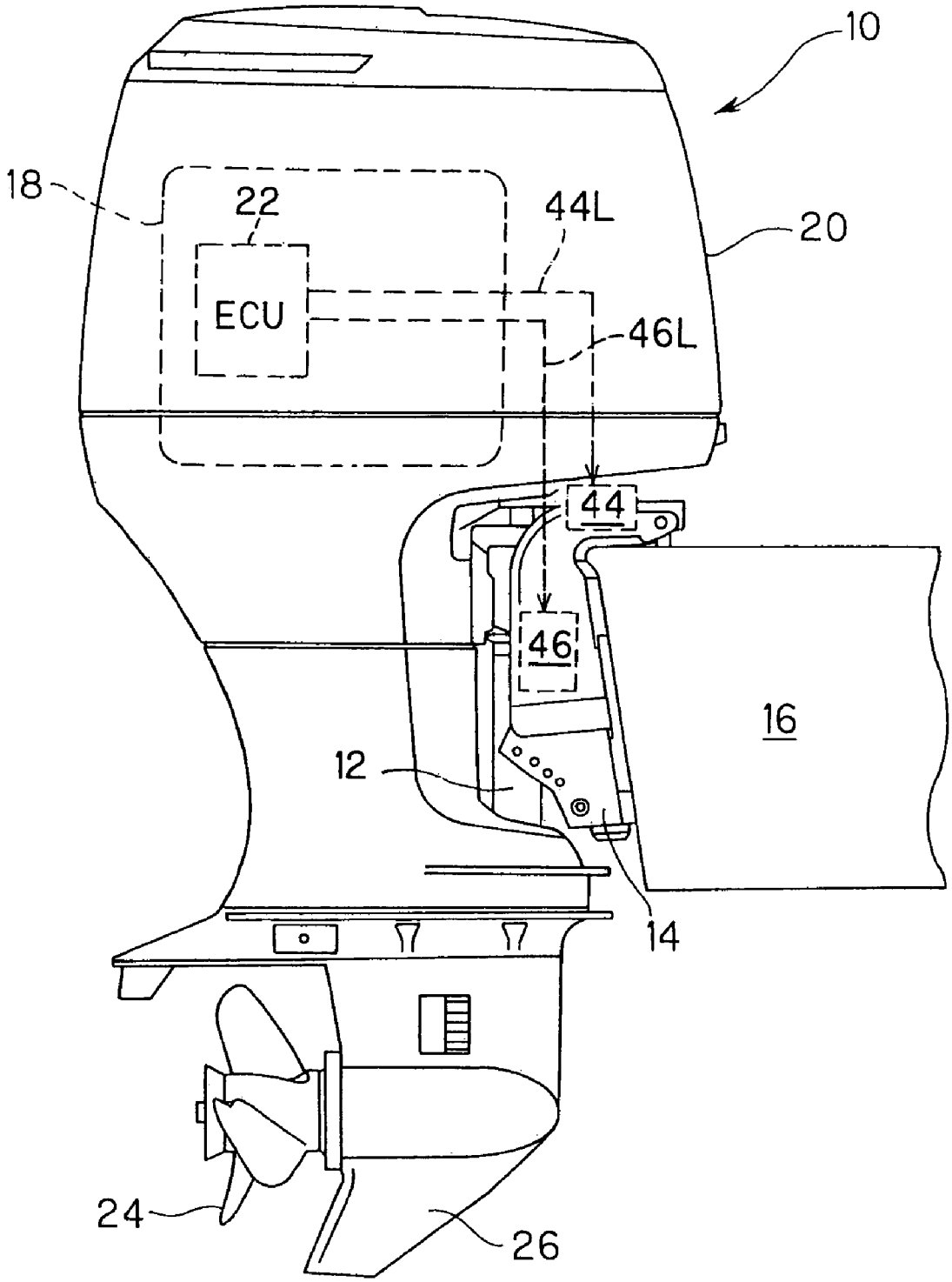
FIG. 2 is an explanatory partial side view of the system shown in FIG. 1.

FIG. 1 is an overall schematic view of a boat incorporating an outboard motor steering system according to a first illustrative embodiment of the invention, with primary focus on the outboard motor. FIG. 2 is an explanatory partial side view of the system shown in FIG. 1.

In FIGS. 1 and 2, the symbol 10 indicates an outboard motor comprising an internal combustion engine, propeller shaft, propeller and other components integrated into a single unit. As shown in FIG. 2, the outboard motor 10 is mounted on the stern of a hull (boat) 16 through a swivel case 12 that houses a rotatable swivel shaft (explained later) and stem brackets 14 connected to the swivel case 12.

The outboard motor 10 is equipped with an internal combustion engine (hereinafter called simply "engine) 18 at its upper part. The engine 18 may be a spark-ignition, in-line, four-cylinder, four-cycle gasoline engine with a displacement of 2,200 cc. The engine 18, located inside the outboard motor 10, is enclosed by an engine cover 20 and positioned above the water surface. An electronic control unit (ECU) 22 including a microcomputer is installed near the engine 18 enclosed by the engine cover 20.

The outboard motor 10 is equipped at its lower part with a propeller 24 and a rudder 26. The propeller 24, which operates to propel the boat 16 in the forward and reverse directions, is powered by the engine 18 through a crankshaft, drive shaft, gear mechanism and shift mechanism (none of which is shown).

As shown in FIG. 1, a steering wheel 28 is installed near the operator's seat of the boat 16. A steering angle sensor 30 is installed near the steering wheel 28. The steering angle sensor 30 comprises a rotary encoder that outputs a signal indicative of the steering angle (amount) of the steering wheel 28 manipulated by the operator. A hydraulic damper (manipulation load regulation mechanism; not illustrated in FIG. 1) is connected to the steering wheel 28 for regulating the manipulation load thereof experienced by an operator.

A throttle lever 32 and a shift lever 34 are mounted near the operator's seat. The throttle lever 32 and shift lever 34 are connected to a throttle valve and the shift mechanism (neither shown) of the engine 18, respectively, through push-pull cables (not shown). The shift mechanism is operated by manipulation of the shift lever 34 to select the direction of travel of the boat 16. The throttle valve is opened and closed by manipulation of the throttle lever 32 to regulate the engine speed, and thus regulate the speed of the boat 16.

A power tilt switch 36 for regulating the tilt angle and a power trim switch 38 for regulating the trim angle of the outboard motor 10 are also installed near the operator's seat. These switches output signals in response to tilt up/down and trim up/down instructions input by the operator. The outputs of the steering angle sensor 30, power tilt switch 36 and power trim switch 38 are sent to the ECU 22 over signal lines 30L, 36L and 38L.

Referring now to FIG. 2, an electric steering motor (steering actuator) 44 and a conventional power tilt-trim unit 46 for regulating trim angle and tilt angle, respectively, are provided near the swivel case 12 and stem brackets 14.

Figure 3:
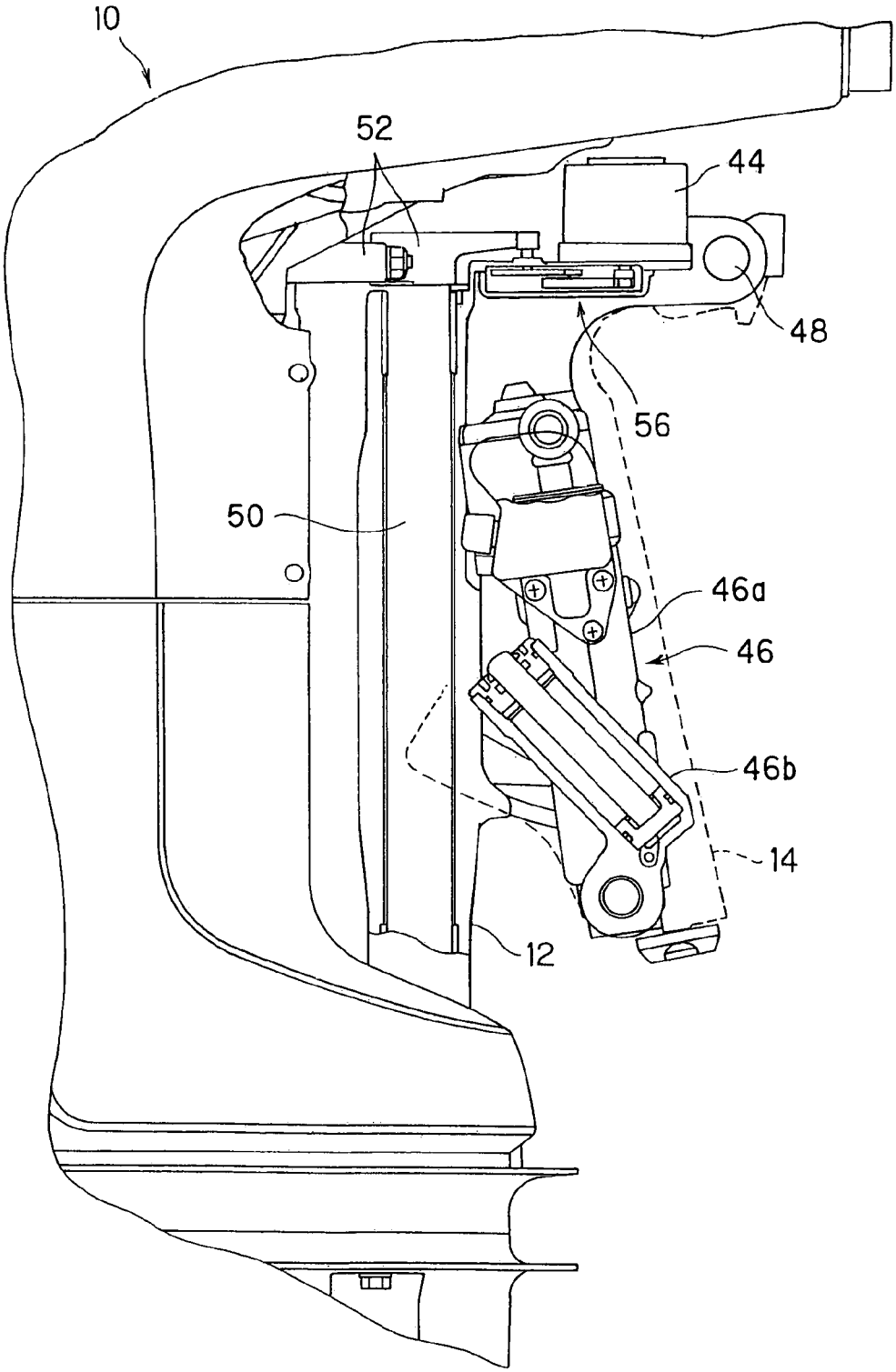
FIG. 3 is a partial sectional diagram giving an enlarged view of a region of a swivel case shown FIG. 2.

FIG. 3 is a partial sectional diagram giving an enlarged view of the region of a swivel case 12 shown FIG. 2.

As shown in FIG. 3, the swivel case 12 is connected to the stem brackets 14 through a tilting shaft 48. A swivel shaft 50 is rotatably housed in the swivel case 12. The steering mechanism of the outboard motor 10 is constituted by the swivel case 12 and swivel shaft 50. The upper end of the swivel shaft 50 is fastened to a mount frame 52 and the lower end thereof is fastened to a lower mount center housing (not shown). The mount frame 52 and lower mount center housing are fastened to the frame on which the engine 18, etc., are mounted.

The steering motor 44 and a gear mechanism 56 for reducing the output speed of the steering motor 44 and transmitting it to the mount frame 52 are fastened to an upper portion of the swivel case 12. Specifically, the main case of the steering motor 44 is connected to the swivel case 12 and the output shaft of the steering motor 44 is operatively connected to the swivel shaft 50 through the gear mechanism 56 and the mount frame 52. Thus the steering motor 44 rotates the swivel shaft 50 so that the outboard motor 10 is steered (rotated) about a vertical axis. The maximum steering angle of the outboard motor 10 is 60 degrees, namely, 30 degrees to the left and 30 degrees to the right.

The power tilt-trim unit 46 integrally comprises one hydraulic cylinder 46*a* for tilt angle regulation (hereinafter called "tilt hydraulic cylinder") and two hydraulic cylinders 46*b* for trim angle regulation (only one shown; hereinafter called "trim hydraulic cylinders").

The cylinder bottom of the tilt hydraulic cylinder 46*a* is fastened to the stem brackets 14 and through them to the boat 16 and the head of the piston rod thereof abuts on the swivel case 12. The cylinder bottom of each trim hydraulic cylinder 46*b* is fastened to the stem brackets 14 and through them to the boat 16 and the head of the piston rod thereof abuts on the swivel case 12. Thus, when the piston rods of the tilt hydraulic cylinder 46*a* and trim hydraulic cylinders 46*b* extend or contract, members associated with the outboard motor 10 other than the stern brackets 14 rotate about the tilting shaft 48, thereby regulating the tilt angle and trim angle.

The explanation of FIG. 2 will now be resumed. The steering motor 44 and power tilt-trim unit 46 are connected to the ECU 22 through signal lines 44L and 46L, respectively.

The ECU 22 controls operation of the steering motor 44 to rotate the swivel shaft 50, based on the steering angle detected by the steering angle sensor 30, and to thereby steer the outboard motor 10. Further, based on the outputs of the power tilt switch 36 and power trim switch 38, the ECU 22 controls the pistons rods of the hydraulic cylinders of the power tilt-trim unit 46 to extend/contract to regulate the tilt angle and/or the trim angle of the outboard motor 10.

Figure 4:
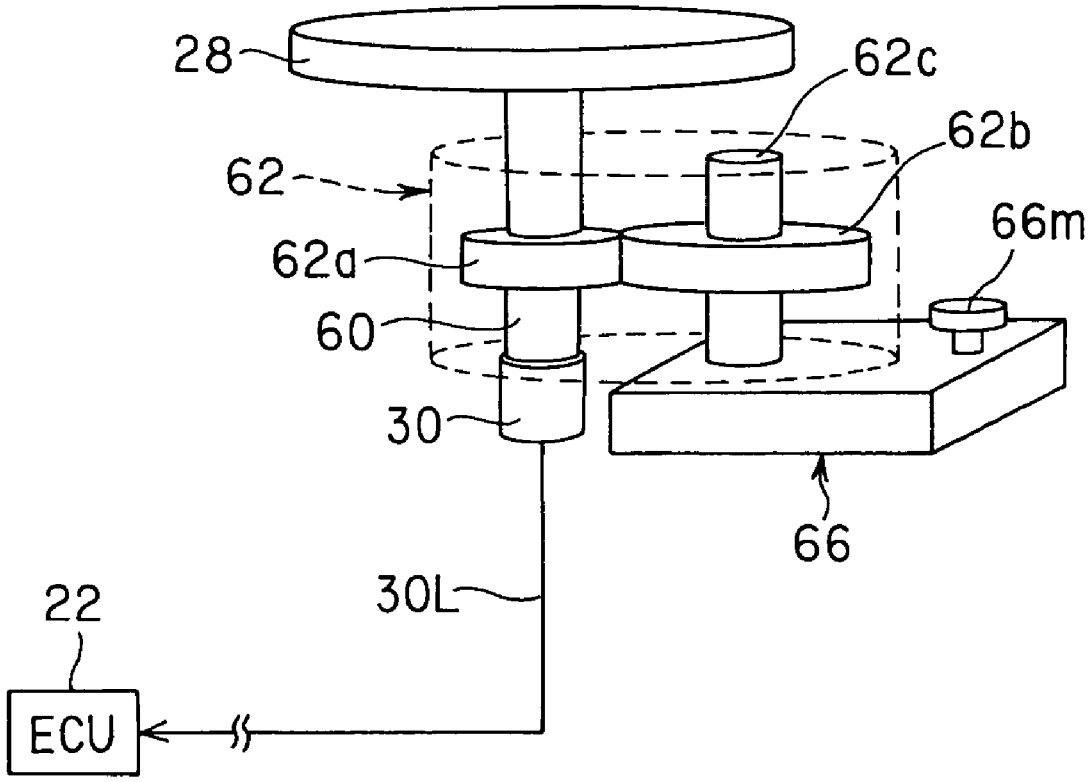
FIG. 4 is a schematic illustration of a region of a steering wheel shown in FIG. 1.

FIG. 4 is a schematic illustration of a region of the steering wheel 28.

As shown in FIG. 4, a steering shaft 60 is connected to the steering wheel 28. The steering shaft 60 is rotatably supported by a steering column (not shown) and the steering angle sensor 30 is attached at the distal end of the steering shaft 60. As is clear from FIG. 4, the steering wheel 28 and outboard motor 10 are mechanically isolated from each other and connected only through the electrical connection between the steering angle sensor 30 and ECU 22.

The steering shaft 60 is connected to the hydraulic damper (now designated by symbol 66) through a speed reducer 62. The speed reducer 62 is equipped with a driving gear 62*a* attached to the steering shaft 60, a follower gear 62*b* meshed with the driving gear 62*a*, and an output shaft 62*c* attached to the follower gear 62*b*. The output shaft 62*c* is connected to the hydraulic damper 66. The hydraulic damper 66 produces a load to be added to steering load of the steering wheel 28 so as to regulate the steering load of the steering wheel 28.

Figure 5:
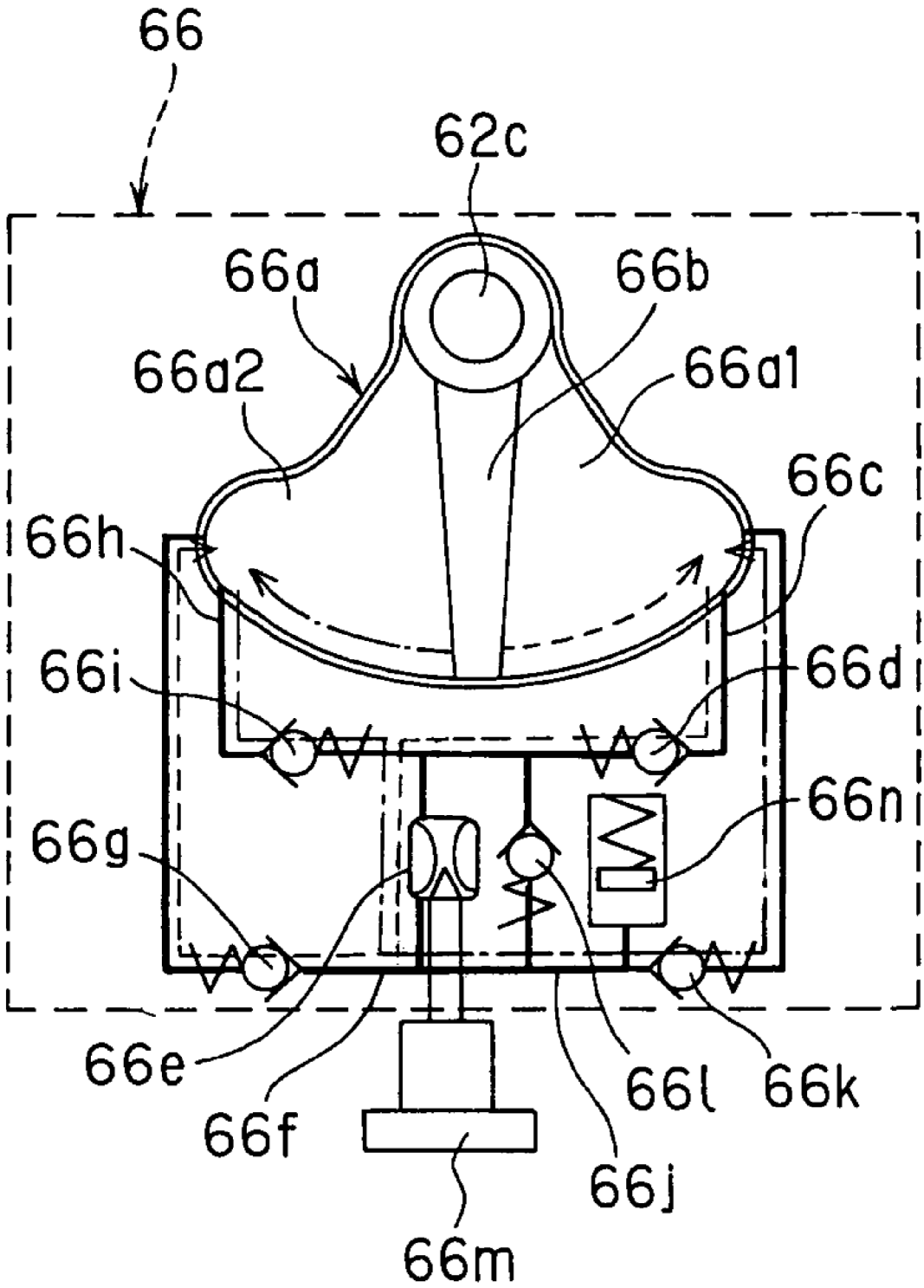
FIG. 5 is an explanatory schematic view representing the hydraulic circuit of a hydraulic damper shown in FIG. 4.

FIG. 5 is an explanatory view representing the hydraulic circuit of the hydraulic damper 66.

As shown in FIG. 5, the hydraulic damper 66 comprises a housing having an oil-filled oil chamber 66*a* formed therein, a vane 66*b* swingably housed in the oil chamber 66*a* for dividing the oil chamber 66*a* into two chambers, oil passages or lines formed in the housing, to be explained later, and valves installed in the oil passages. In the following, the chamber that the vane 66*b* partitions off on the right side of the drawing sheet is referred to as the "first chamber" and assigned the symbol 66*a*1, while the partitioned off chamber on the left side of the drawing sheet is referred to as the "second chamber" and assigned the symbol 66*a*2.

The rotary shaft of the vane 66*b* is connected to the output shaft 62*c* of the speed reducer 62. When the steering wheel 28 is manipulated (rotated), the rotation is transferred through the steering shaft 60 and speed reducer 62 to swing or move the vane 66*b*. Specifically, when the steering wheel 28 is turned clockwise (steered right (starboard)), the rotation acts through the speed reducer 62 to swing or move the vane 66*b* counterclockwise. When the steering wheel 28 is turned counterclockwise (steered left (port)), the vane 66*b* is rotated clockwise. The lock-to-lock of the steering wheel 28 is 2.5 revolutions and the speed reduction ratio of the speed reducer 62 is 1/15. As a result, the vane 66*b* can swing or move 60 degrees, namely, 30 degrees clockwise and 30 degrees counterclockwise.

The operation of the hydraulic circuit shown in FIG. 5 will now be explained. As indicated by the arrow of the broken line in FIG. 5, when the steering wheel 28 is turned clockwise, swinging the vane 66*b* counterclockwise, the oil sealed in the first chamber 66*a*1 flows into an oil passage 66*c*, passes through an intermediately located check valve 66*d* and reaches an orifice 66*e*. The oil passing through the orifice 66*e* flows into an oil passage 66*f*, through an intermediately located check valve 66*g*, and into the second chamber 66*a*2.

On the other hand, as indicated by the arrow of the alternate long and short dashed line in the drawing, when the steering wheel 28 is turned counterclockwise, swinging the vane 66*b* clockwise, the oil sealed in the second chamber 66*a*2 flows into an oil passage 66*h*, passes through an intermediately located check valve 66*i* and reaches the orifice 66*e*. The oil passing through the orifice 66*e* flows into an oil passage 66*j*, through an intermediately located check valve 66*k*, and into the first chamber 66*a*1.

When the torque applied to the steering wheel 28 by the operator is so large that the oil pressure in the oil passage 66*c* or oil passage 66*h* exceeds a predetermined value, the oil flow rate is increased by opening a relief valve 66*l* situated so as to bypass the orifice 66*e*.

The orifice 66*e* is equipped with a manual valve (manual adjuster) 66*m* for regulating or adjusting the opening area of the orifice 66*e*. As shown in FIG. 4, the manual valve 66*m* projects outward from the hydraulic damper 66 to be operable by the operator. The symbol 66*n* in FIG. 5 designates a free piston 66*n* for preventing oil cavitation.

Thus when the vane 66*b* is swung moved, oil sealed in one chamber passes through the orifice 66*e* to flow into the other chamber. The flow resistance of the oil passing through the orifice 66*e* increases the manipulation load of the vane 66*b* and this in turn regulates the manipulation load of the steering wheel 28 upward. (In the following, the manipulation load of the vane 66*b* added to the manipulation load of the steering wheel 28 is referred to as the "added load" produced by the hydraulic damper 66.) The added load produced by the hydraulic damper 66 can be changed as desired by using the manual valve 66*m* to regulate or adjust the opening area of the orifice 66*e*.

As explained in the foregoing, the outboard motor steering system according to the first embodiment is equipped with the steering motor 44 connected to the swivel shaft 50, which is a constituent of the steering mechanism of the outboard motor 10, the steering angle sensor 30 for detecting the steering angle of the steering wheel 28 installed on the boat 16, and the hydraulic damper 66. The steering motor 44 is driven based on the detected steering angle, thereby steering the outboard motor 10, and the hydraulic damper 66 produces an added load for increasing the manipulation load of the steering wheel 28, thereby regulating the manipulation load of the steering wheel 28 experienced by the operator. It is therefore possible to reduce the burden on the operator by using the steering motor 44 as an actuator for steering the outboard motor 10, while also achieving an improvement in operating feel by regulating the manipulation load of the steering wheel 28 in the increase direction.

Moreover, the amount of added load generated by the hydraulic damper 66 can be regulated to a desired value by adjusting the opening area of the orifice 66*e*. The outboard motor steering system according to the first embodiment therefore has the particular merit of enabling simple regulation of the manipulation load of the steering wheel 28 to the optimum value.

In addition, the provision of the manual valve 66*m* at the orifice 66*e* allows the operator to change the added load produced by the hydraulic damper 66 as desired. The operator can therefore set or determine the manipulation load of the steering wheel 28 according to personal preference and thus enjoy an improved operating feel.

Although in the foregoing explanation the damper has been defined as a hydraulic damper that utilizes oil, the damper can instead be one that utilizes any of various other fluids. Also, instead of the damper of vane type, that of piston type or the like can be used.

An outboard motor steering system according to a second embodiment of the invention will now be explained.

Figure 6:
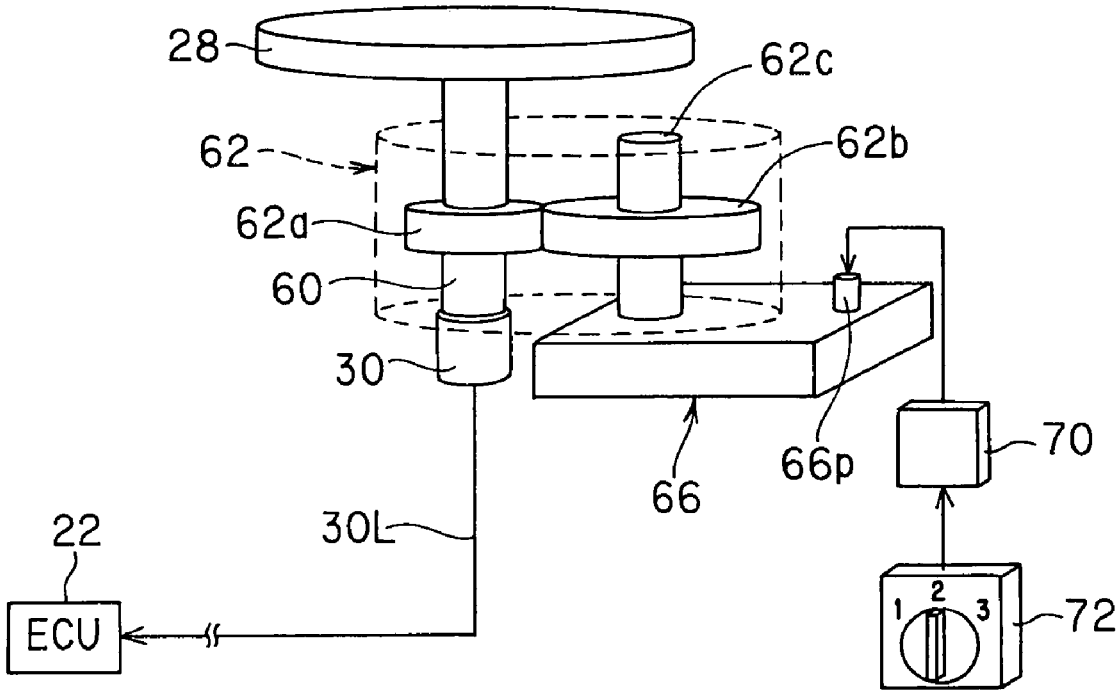
FIG. 6 is a schematic illustration, similar to FIG. 4, but showing an outboard motor steering system according to a second embodiment of the invention.
Figure 7:
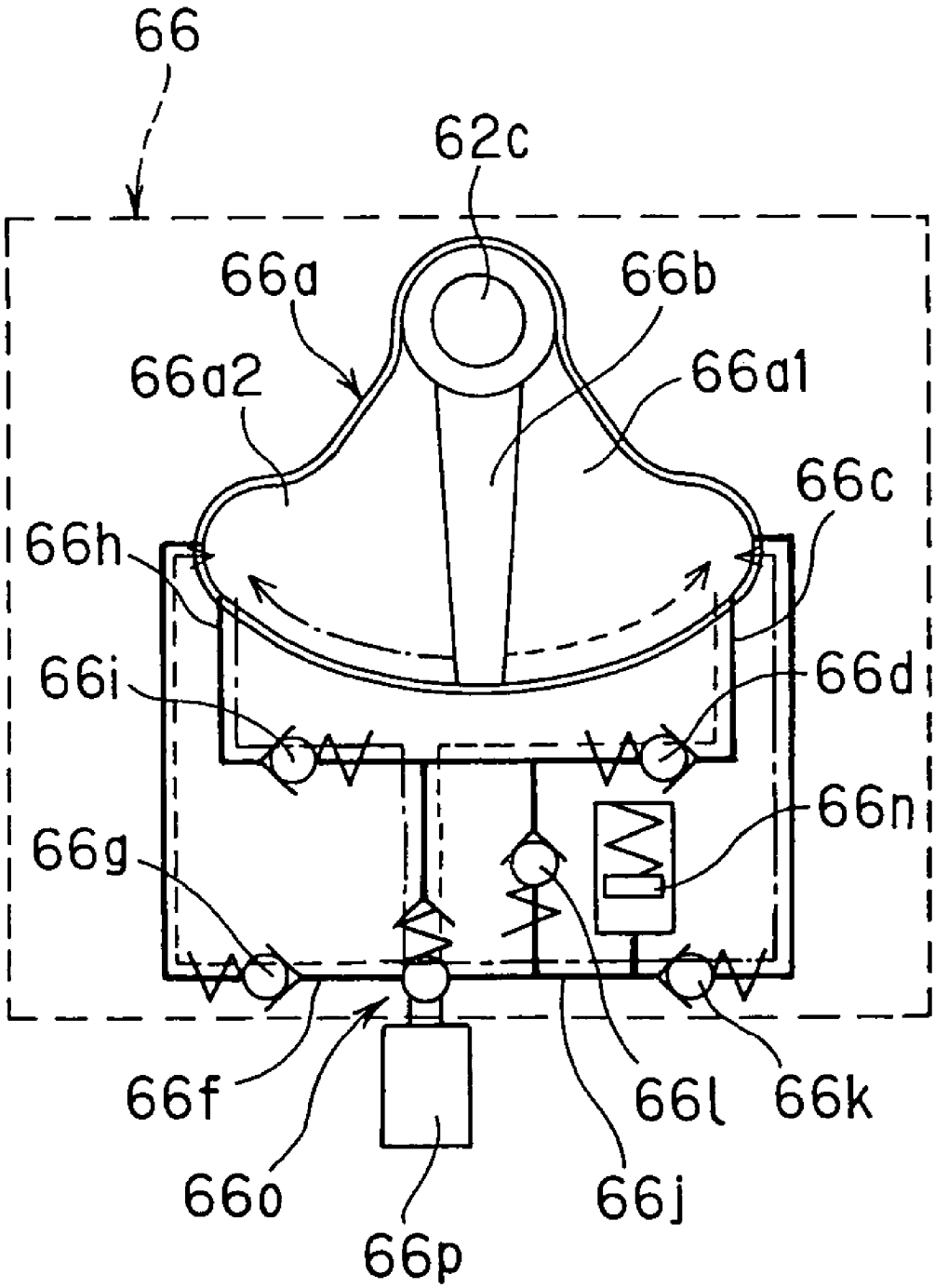
FIG. 7 is an explanatory schematic view, similar to FIG. 5, but representing the hydraulic circuit of a hydraulic damper shown in FIG. 6.

FIG. 6 is a schematic illustration, similar to FIG. 4, but showing an outboard motor steering system according to a second embodiment of the invention. FIG. 7 is an explanatory view, similar to FIG. 5, but representing the hydraulic circuit of a hydraulic damper shown in FIG. 6.

The explanation will be made with focus on points of difference from the first embodiment. In the second embodiment, as shown in FIG. 7, the orifice 66*e* and manual valve 66*m* are replaced by an electromagnetic solenoid valve 66*o*. In this configuration, the opening (i.e., oil passage area) of the solenoid valve 66*o* is regulated to adjust the fluid resistance of the oil, thereby changing the added load produced by the hydraulic damper 66 and varying the manipulation load of the steering wheel 28.

This will be explained in more detail. As indicated by the arrow of the broken line in FIG. 7, when the steering wheel 28 is turned clockwise to swing the vane 66*b* counterclockwise, the oil sealed in the first chamber 66*a*1 flows into the oil passage 66*c*, passes through the intermediately located check valve 66*d* and reaches the solenoid valve 66*o*. The oil passing through the solenoid valve 66*o* flows into the oil passage 66*f*, through the intermediately located check valve 66*g*, and into the second chamber 66*a*2.

On the other hand, as indicated by the arrow of the alternate long and short dashed line in FIG. 7, when the steering wheel 28 is turned counterclockwise to swing the vane 66*b* clockwise, the oil sealed in the second chamber 66*a*2 flows into the oil passage 66*h*, passes through the intermediately located check valve 66*i* and reaches the solenoid valve 66*o*. The oil passing through the solenoid valve 66*o* flows into the oil passage 66*j*, through the intermediately located check valve 66*k*, and into the first chamber 66*a*1.

The solenoid valve 66*o* has a linear (electromagnetic) solenoid 66*p*. As shown in FIG. 6, the linear solenoid 66*p* is connected to a solenoid controller (control unit) 70. Like the ECU 22, the solenoid controller 70 is constituted of a microcomputer and is additionally connected to a load selector switch (manual adjuster) 72 that can be manually operated by the operator. The solenoid controller 70 is supplied with operating power by a battery not shown in the drawings.

As shown in FIG. 6, the load selector switch 72 has three positions, any of which can be selected by the operator. A signal indicating the selected position is sent to the solenoid controller 70. The solenoid controller 70 supplies the linear solenoid 66*p* with a voltage corresponding to the selected switch position indicated by the signal. Specifically, the voltages supplied when the positions marked "1," "2" and "3" in the drawing are selected are, respectively, a first voltage, a second voltage set higher than the first voltage, and a third voltage set higher than the second voltage. As a result, the opening of the solenoid valve 66*o* is regulated to vary the added load produced by the hydraulic damper 66.

The solenoid valve 66*o* is driven farther in the valve closing direction to increase the added load produced by the hydraulic damper 66 in proportion as the voltage supplied to the linear solenoid 66*p* is larger. In other words, the manipulation load of the steering wheel 28 increases progressively as the load selector switch 72 is switched through the positions "1" to "3."

Since the remaining constituent elements of the second embodiment are the same as those of the first embodiment, they are assigned like reference symbols and will not be explained again.

The outboard motor steering system according to the second embodiment is configured so that by regulating the opening of the solenoid valve 66*o* the operator can vary the added load produced by the hydraulic damper 66 as desired. Therefore, as in the case of the first embodiment, the operator can set or determine the manipulation load of the steering wheel 28 according to personal preference and thus enjoy an improved operating feel.

Although the load selector switch 72 has been explained as having three steps or positions in the foregoing, the number of positions can instead be two or four or more. A configuration enabling continuous (i.e., without step) regulation is also possible.

An outboard motor steering system according to a third embodiment of the invention will now be explained.

Figure 8:
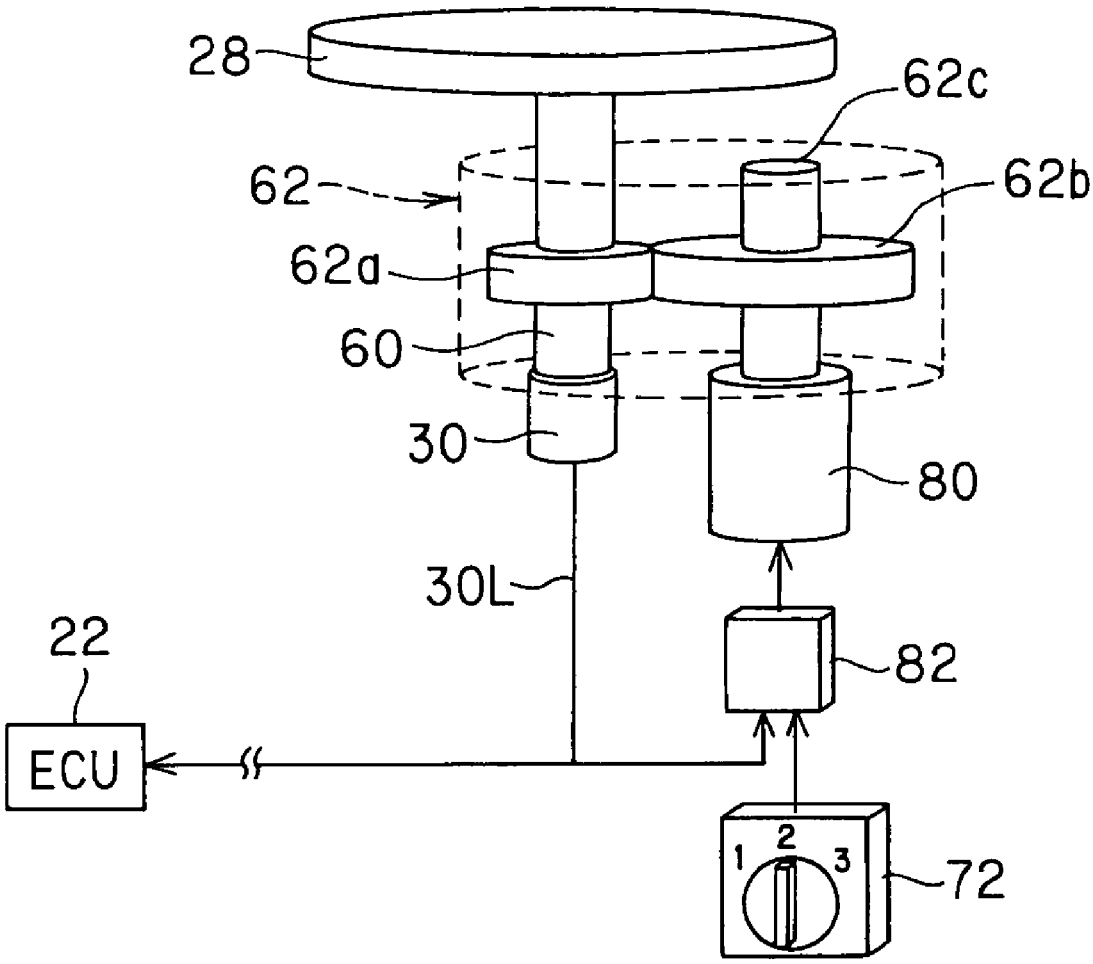
FIG. 8 is a schematic illustration, similar to FIG. 4, but showing an outboard motor steering system according to a third embodiment of the invention.

FIG. 8 is a schematic illustration, similar to FIG. 4, but showing an outboard motor steering system according to the third embodiment.

The explanation will be made with focus on points of difference from the earlier embodiments. In the third embodiment, as shown in FIG. 8, the hydraulic damper 66 is replaced by an electric motor (manipulation load regulation mechanism) 80 (hereinafter called the "load-generating motor") that is used as an electrical brake for regulating the manipulation load of the steering wheel 28.

This will be explained in more detail. The output shaft (not shown) of the load-generating motor 80 is connected to the output shaft 62*c* of the speed reducer 62. A motor controller (control unit) 82 is connected to the load-generating motor 80. The load selector switch 72 (same as that of the second embodiment), the battery (not shown), and the steering angle sensor 30 are connected to the motor controller 82. Like the ECU 22 and solenoid controller, the motor controller 82 is also constituted of a microcomputer, and is provided with the outputs of the steering angle sensor 30 and the load selector switch 72. The motor controller 82 controls the operation of the load-generating motor 80 based on the outputs of the steering angle sensor 30 and the load selector switch 72.

Figure 9:
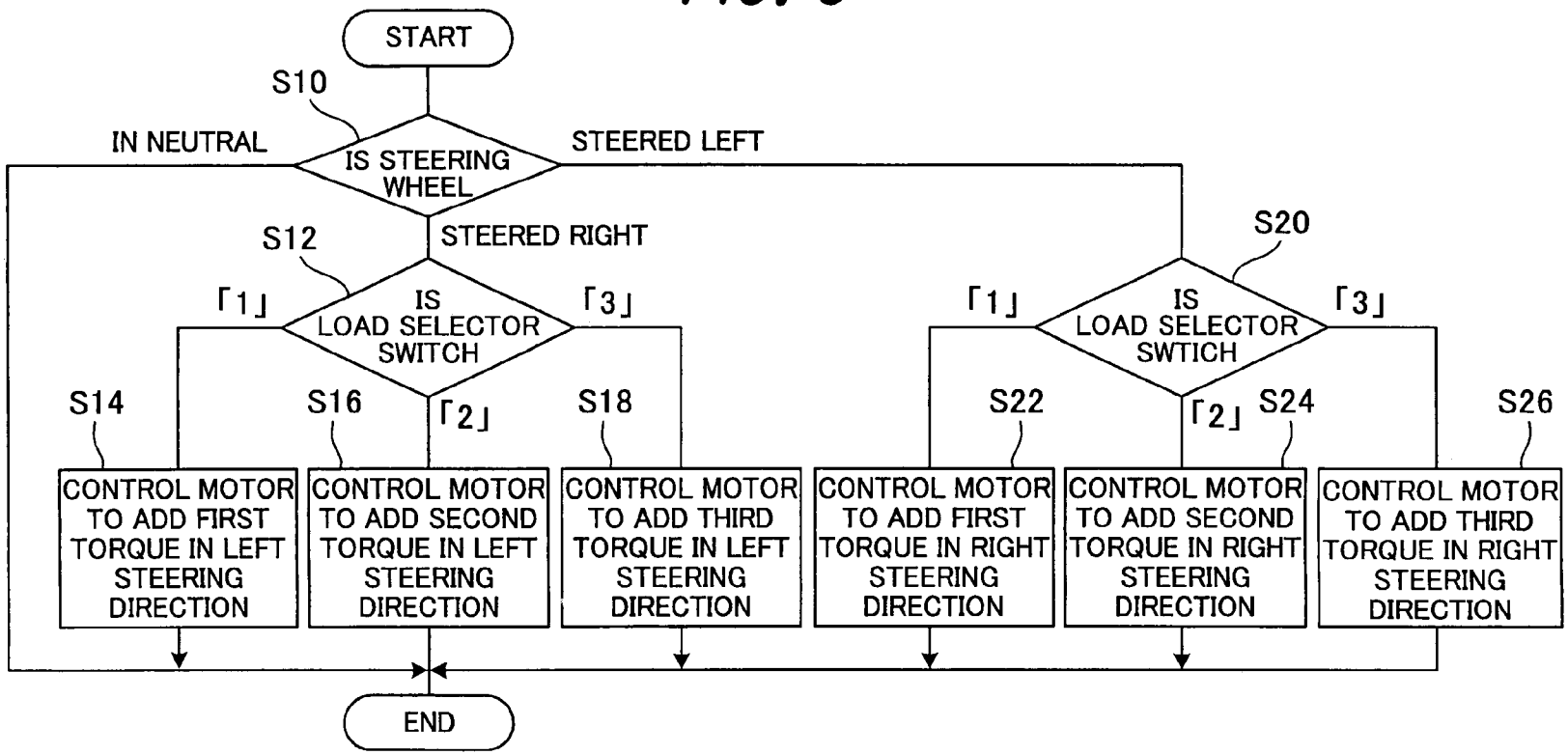
FIG. 9 is a flowchart showing the sequence of operations of a motor controller for controlling a load-generating electric motor shown in FIG. 8.

FIG. 9 is a flowchart showing the sequence of operations of the motor controller 82 for controlling the load-generating motor 80. The routine of this flowchart is activated once every 20 msec, for example.

First, in S10, the output of the steering angle sensor 30 is used to determine the steering (manipulation) direction of the steering wheel 28. When it is determined in S10 that the steering wheel 28 is steered (manipulated) right (starboard), the program proceeds to S12, in which the position of the load selector switch 72 is determined.

When it is determined in S12 that the load selector switch 72 is in position "1," the program proceeds to S14, in which the load-generating motor 80 is controlled to add a first torque in the left (port) steering direction of the steering wheel 28. In other words, the direction and amount of the current supplied to the load-generating motor 80 is controlled so as to produce a torque in the direction opposite from the turning direction of the steering wheel 28. (Hereinafter torque to be applied in the direction opposite from the turning direction of the steering wheel 28 is referred to as the "added load" produced by the load-generating motor 80.)

When it is determined in S112 that the load selector switch 72 is in position "2," the program proceeds to S16, in which the load-generating motor 80 is controlled to add a second torque larger than the first torque in the left (port) steering direction of the steering wheel 28. When it is determined in S12 that the load selector switch 72 is in position "3," the program proceeds to S18, in which the load-generating motor 80 is controlled to add a third torque larger than the second torque in the left (port) steering direction of the steering wheel 28.

On the other hand, when it is determined in S10 that the steering wheel 28 is steered (manipulated) left (port), the program proceeds to S20, in which the position of the load selector switch 72 is determined.

When it is determined in S20 that the load selector switch 72 is in position "1," the program proceeds to S22, in which the load-generating motor 80 is controlled to add the first torque in the right (starboard) steering direction of the steering wheel 28. When it is determined in S20 that the load selector switch 72 is in position "2," the program proceeds to S24, in which the load-generating motor 80 is controlled to add the second torque in the right (starboard) steering direction of the steering wheel 28. When it is determined in S20 that the load selector switch 72 is in position "3," the program proceeds to S26, in which the load-generating motor 80 is controlled to add the third torque in the right (starboard) steering direction of the steering wheel 28.

When the steering wheel 28 is determined to be in the neutral position (non-steered position) in S10, the remaining steps of the routine are skipped (no torque is added).

Since the remaining constituent elements of the third embodiment are the same as those of the earlier embodiments, they are assigned like reference symbols and will not be explained again.

The outboard motor steering system according to the third embodiment is configured to use the load-generating motor 80 as an electrical brake for regulating the direction in which the manipulation load of the steering wheel 28 of the operator is increased. Therefore, as in the case of the earlier embodiments, the operator can enjoy an improved operating feel.

Moreover, the amount of added load generated by the load-generating motor 80 can be easily set or determined to the desired value by adjusting the voltage supplied to the load-generating motor 80. The outboard motor steering system according to the third embodiment therefore has the particular merit of enabling simple regulation of the manipulation load of the steering wheel 28 to the optimum value.

In addition, the magnitude of the added load produced by the load-generating motor 80 can be varied as desired by manipulating the load selector switch 72. The operator can therefore set or determine the manipulation load of the steering wheel 28 according to personal preference and thus enjoy an improved operating feel.

Although it has been explained in the foregoing that an added load (torque in the direction opposite from the turning direction of the steering wheel 28) is produced by controlling the direction and amount of the current supplied to the load-generating motor 80, it is possible instead to utilize generator braking obtained when supply of current is stopped, if the electric motor 80 is an electric generator-motor. In this case, the generator braking can be more effectively utilized by replacing the speed reducer 62 with a speed-increasing mechanism so as to increase the speed at which the load-generating motor 80 is rotated.

An outboard motor steering system according to a fourth embodiment of the invention will now be explained.

Figure 10:
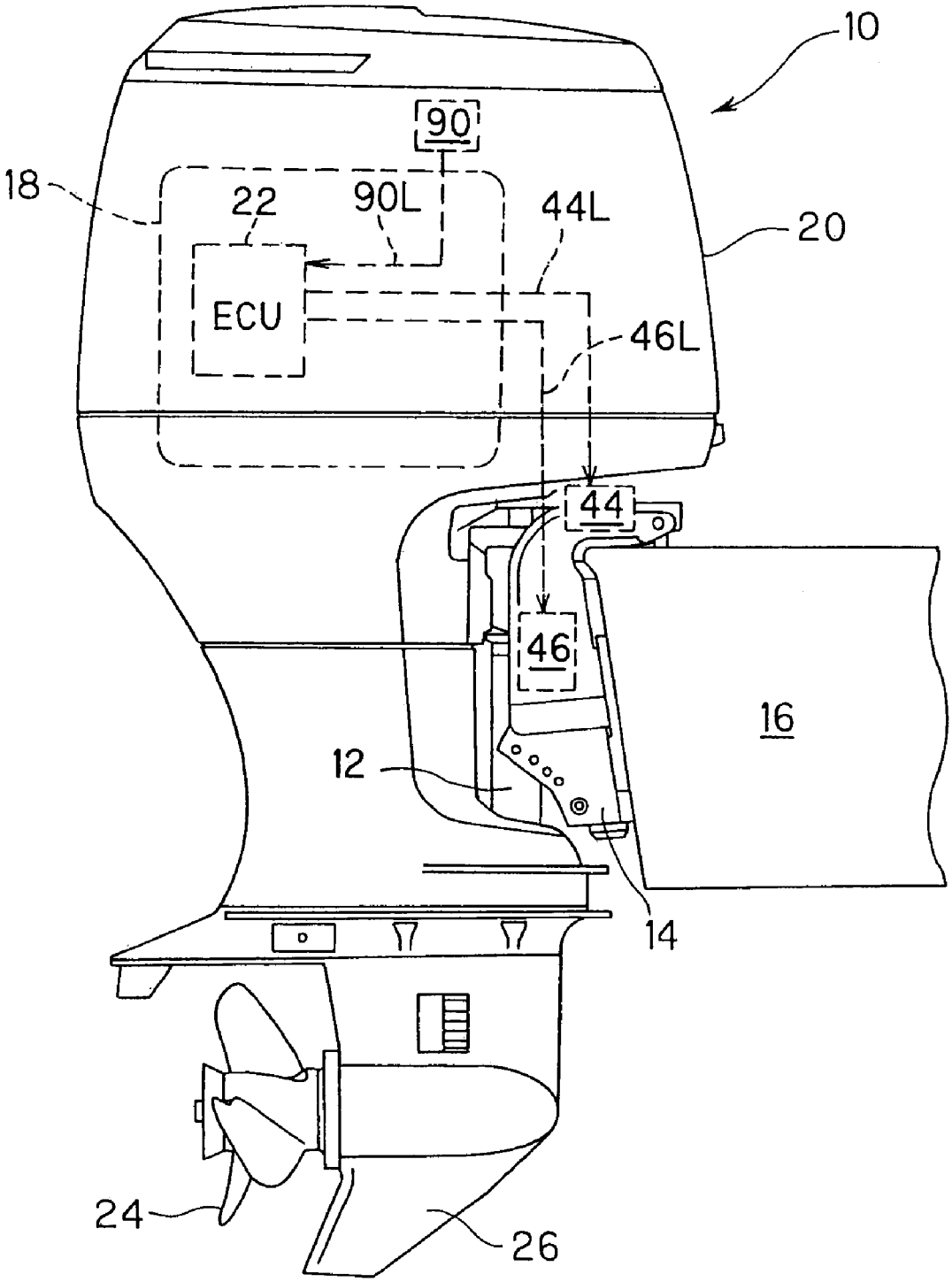
FIG. 10 is an explanatory partial side view, similar to FIG. 2, but showing an outboard motor steering system according to a fourth embodiment of the invention.

FIG. 10 is an explanatory partial side view, similar to FIG. 2, but showing an outboard motor steering system according to a fourth embodiment of the invention.

The explanation will be made with focus on points of difference from the earlier embodiments. In the fourth embodiment, the speed of the engine 18 is detected as a value indicative of the speed of the boat 16 and the augmentative load to be added to the manipulation load of the steering wheel 28 is automatically varied based on the detected engine speed.

This will be explained in greater detail. As shown in FIG. 10, a crankangle sensor 90 is installed near the crankshaft (not shown) of the engine 18. The crankangle sensor 90 outputs a pulse signal once every predetermined crankangle (e.g., 30 degrees). The pulse signals outputted by the crankangle sensor 90 are sent to the ECU 22 over a signal line 90L. The ECU 22 uses a counter (not shown) to count the input pulses received from the crankangle sensor 90 via the signal line 90L and detects or calculates the engine speed NE from the count value.

Figure 11:
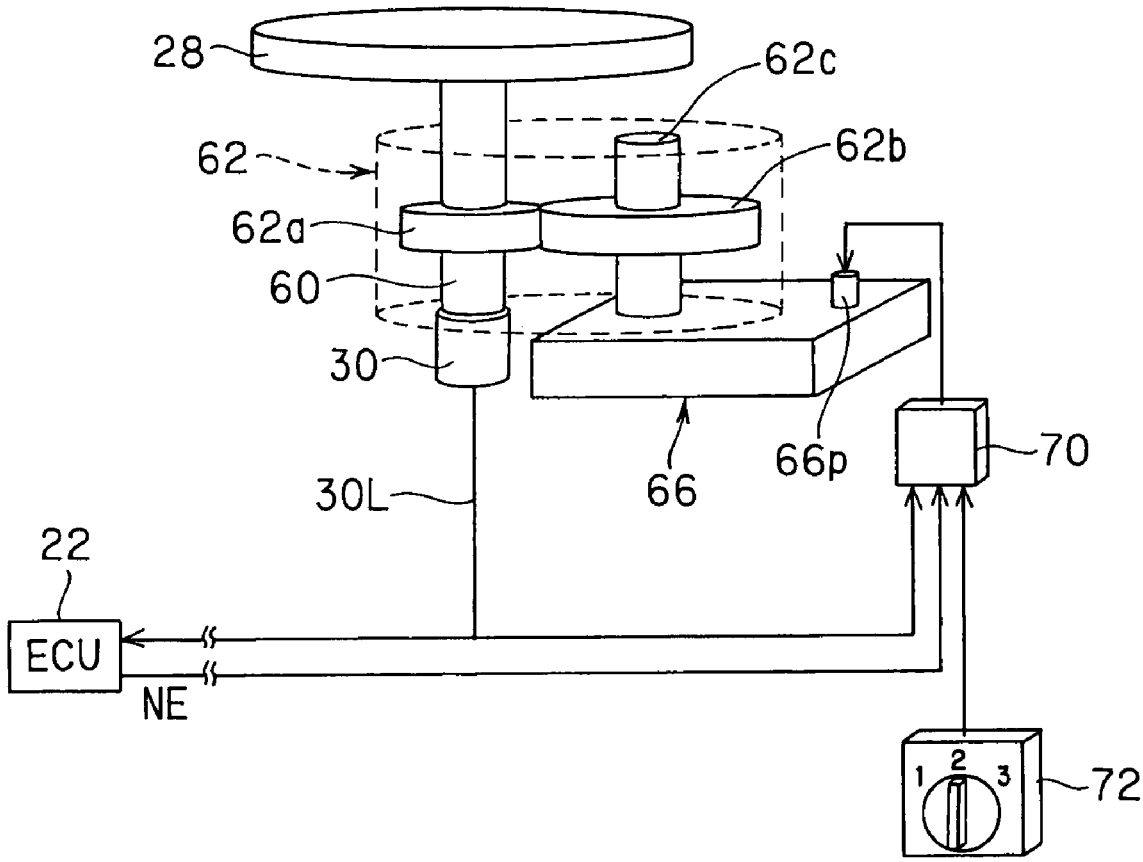
FIG. 11 is a schematic illustration, similar to FIG. 4, but showing the outboard motor steering system according to the fourth embodiment.

FIG. 11 is a schematic illustration, similar to FIG. 4, but showing the outboard motor steering system according to the fourth embodiment. As shown in FIG. 11, the fourth embodiment is equipped with the hydraulic damper 66, the solenoid controller 70 and the load selector switch 72 like those of the second embodiment.

The fourth embodiment differs from the second embodiment in the point that the solenoid controller 70 is supplied with the engine speed NE from the ECU 22. The solenoid controller 70 controls the linear solenoid 66*p* based on the engine speed NE and the signal from the load selector switch 72.

Figure 12:
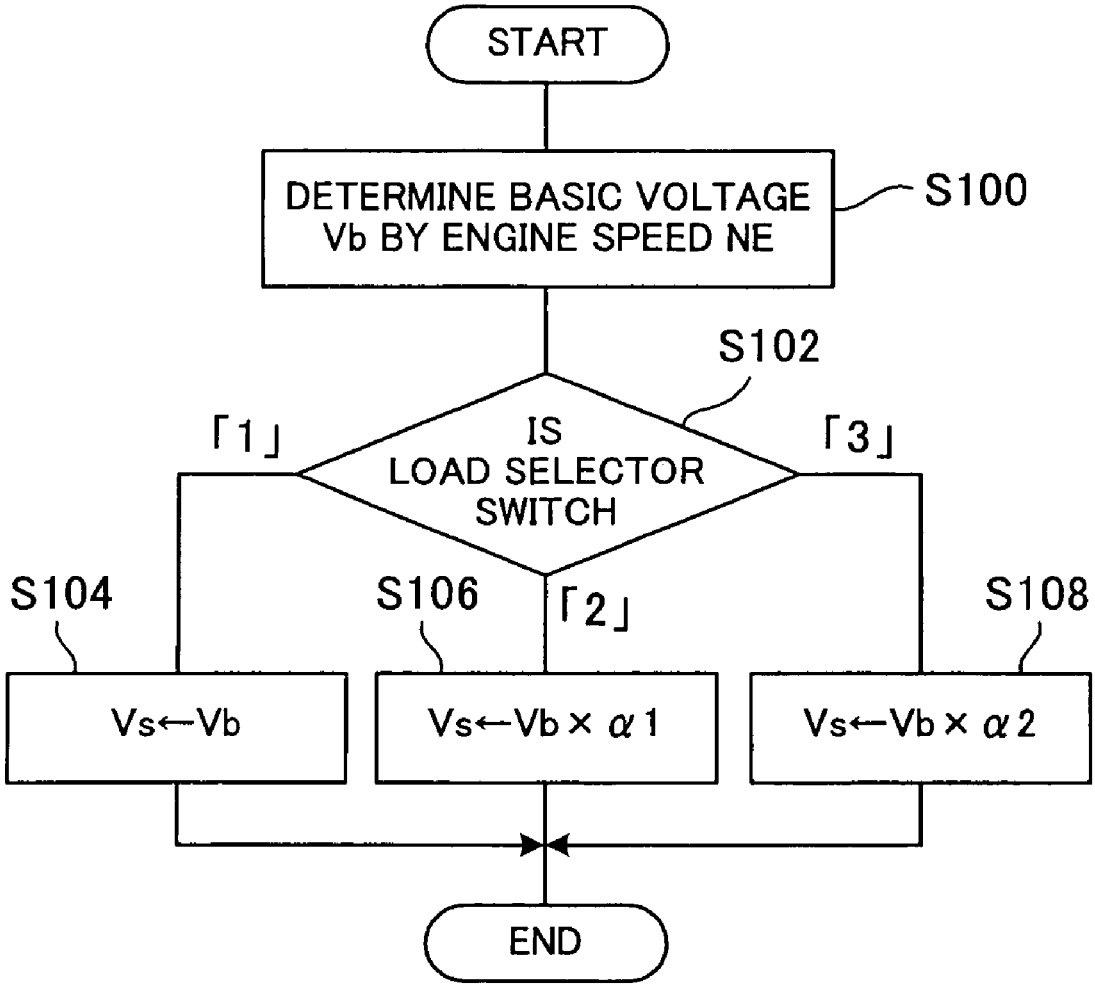
FIG. 12 is a flowchart showing the sequence of operations of a solenoid controller for controlling a linear solenoid shown in FIG. 11.

FIG. 12 is a flowchart showing the sequence of operations of the solenoid controller 70 for controlling the linear solenoid 66*p*. The routine of this flowchart is activated once every 20 msec, for example.

First, in S100, the engine speed NE is used as address data for retrieving a basic voltage Vb from mapped data (not shown). The basic voltage Vb determined by retrieval is a basic voltage value used to determine the voltage Vs supplied to the linear solenoid 66*p* and is defined in the mapped data to increase with increasing engine speed NE.

As in the second embodiment, the solenoid valve 66*o* is driven farther in the valve closing direction to increase the added load produced by the hydraulic damper 66 in proportion as the voltage supplied to the linear solenoid 66*p* is larger. The manipulation load of the steering wheel 28 therefore increases with increasing engine speed NE.

Next, in S102, the selected position of the load selector switch 72 is determined. When it is determined in S102 that the load selector switch 72 is in position "1," the program proceeds to S104, in which the basic voltage Vb retrieved in S1100 is determined as the voltage Vs to be supplied to the linear solenoid 66*p*.

When it is determined in S102 that the load selector switch 72 is in position "2," the program proceeds to S106, in which the value obtained by multiplying the basic voltage Vb by a first coefficient $\alpha$1 is determined as the voltage Vs to be supplied to the linear solenoid 66*p*. The first coefficient $\alpha$1 is defined to be greater than 1. Thus the voltage Vs when the load selector switch 72 is in position "2" is determined to be greater than the voltage Vs when it is in position "1."

When it is determined in S102 that the load selector switch 72 is in position "3," the program proceeds to S108, in which the value obtained by multiplying the basic voltage Vb by a second coefficient $\alpha$2 is determined as the voltage Vs to be supplied to the linear solenoid 66*p*. The second coefficient $\alpha$2 is defined to be greater than the first coefficient $\alpha$1. Thus the voltage Vs when the load selector switch 72 is in position "3" is determined to be greater than the voltage Vs when it is in position "2." At the same engine speed NE, therefore, the manipulation load of the steering wheel 28 increases progressively as the load selector switch 72 is switched through the positions "1" to "3."

Since the remaining constituent elements of the fourth embodiment are the same as those of the earlier embodiments, they are assigned like reference symbols and will not be explained again.

The outboard motor steering system according to the fourth embodiment is configured to detect the engine speed NE of the engine 18 and vary the added load produced by the hydraulic damper 66 based on the detected engine speed NE. The manipulation load of the steering wheel 28 of the operator can therefore be set or determined in accordance with the operating condition so as to offer a further improvement in operating feel.

Specifically, the manipulation load of the steering wheel 28 is regulated to increase with increasing engine speed NE, so that operability during low-speed running, such as at leaving or approaching shore, is ensured, while also ensuring stable running at high speeds by restraining sharp turning at such times.

Although it has been explained in the foregoing that the operation of the linear solenoid 66*p* is controlled in accordance with the engine speed NE, it is alternatively possible to effect the control on a load-generating motor 80 as in the third embodiment.

Although the engine speed NE is detected as a value indicative of the boat speed in the fourth embodiment, it is alternatively possible to equip the boat 16 with a speedometer or a GPS (global positioning system) for detecting the speed of the boat 16 and control the operation of the linear solenoid 66*p* (or load-generating motor 80) in accordance with the detected boat speed.

An outboard motor steering system according to a fifth embodiment of the invention will now be explained.

Figure 13:
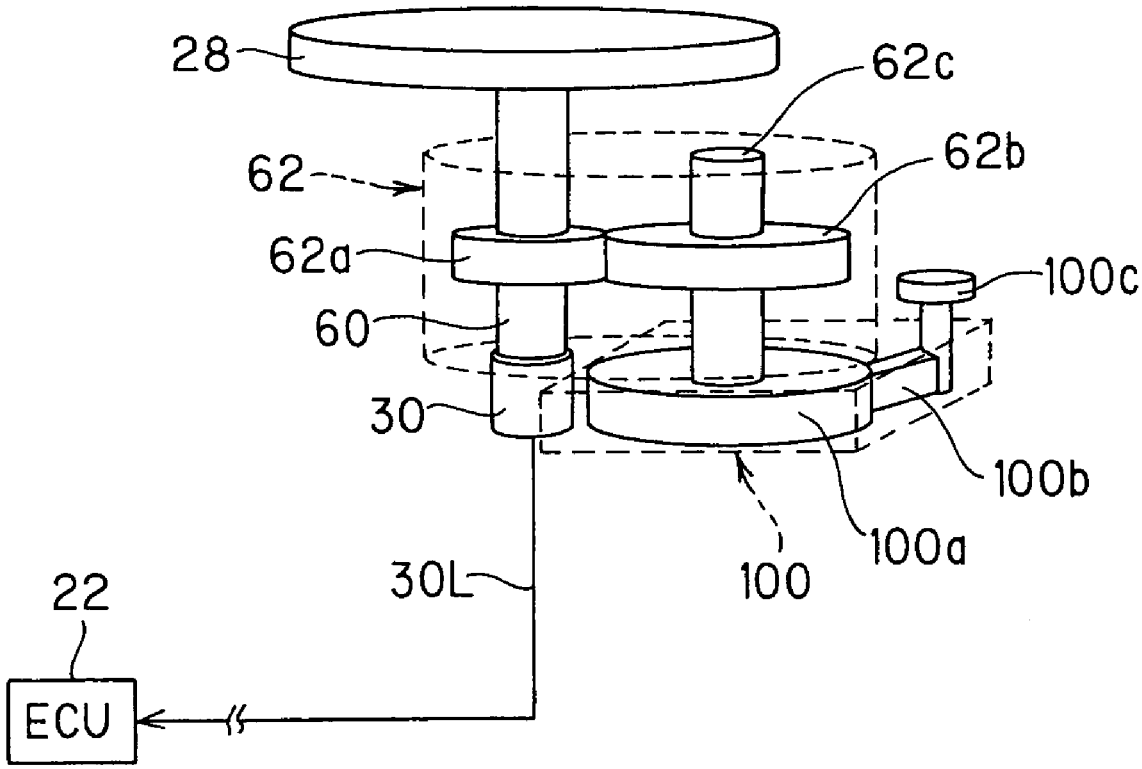
FIG. 13 is a schematic illustration, similar to FIG. 4, but showing an outboard motor steering system according to a fifth embodiment of the invention.

FIG. 13 is a schematic illustration, similar to FIG. 4, but showing an outboard motor steering system according to the fifth embodiment.

The explanation will be made with focus on points of difference from the earlier embodiments. In the fifth embodiment, as shown in FIG. 13, the hydraulic damper 66 is replaced by a friction-generating unit (manipulation load regulation mechanism) 100 that is used as a friction brake for regulating the manipulation load of the steering wheel 28.

This will be explained in more detail. As shown in FIG. 13, a disk 100*a* of the friction-generating unit 100 is connected to the output shaft 62*c* of the speed reducer. A brake pad 100*b* is pressed onto disk 100*a*. In other words, the mechanical friction (frictional force) between the disk 100*a* and brake pad 100*b* is used to regulate the manipulation load of the steering wheel 28 to be increased. (Hereinafter the mechanical friction between the disk 100*a* and brake pad 100*b* to be added to the manipulation load of the steering wheel 28 is referred to as the "added load" produced by the friction-generating unit 100.)

A grip (manual adjuster) 100*c* is connected to the brake pad 100*b* to be manually operable by the operator. The pressure of the brake pad 100*b* on the disk 100*a* (i.e., the added load produced by the friction-generating unit 100) can be varied as desired by manipulating of the grip 100*c*.

Since the remaining constituent elements of the fifth embodiment are the same as those of the earlier embodiments, they are assigned like reference symbols and will not be explained again.

The outboard motor steering system according to the fifth embodiment is configured to use the friction-generating unit 100 as a friction brake for regulating the manipulation load of the steering wheel 28 of the operator to be increased. Therefore, as in the case of the earlier embodiments, the operator can enjoy an improved operating feel.

Moreover, the amount of added load generated by the friction-generating unit 100 can be easily set or determined to the desired value by adjusting the pressure of the brake pad 100*b* on the disk 100*a*. The outboard motor steering system according to the fifth embodiment therefore has the particular merit of enabling simple regulation of the manipulation load of the steering wheel 28 to the optimum value.

In addition, the provision of the grip 100*c* allows the operator to change the added load produced by the friction-generating unit 100 as desired. The operator can therefore manipulate the grip 100*c* to set the manipulation load of the steering wheel 28 according to personal preference and thus enjoy an improved operating feel.

In the foregoing configuration, it is possible to replace the grip 100*c* with an appropriate actuator connected to the brake pad 100*b* and drive the actuator in accordance with the engine speed NE, thereby enabling variation of the manipulation load of the steering wheel 28 with engine speed NE, similarly to in the fourth embodiment.

The first to fifth embodiments are thus configured to have a steering system for an outboard motor 10 mounted on a stem of a boat 16 and having an internal combustion engine 18 and a propeller 24 with a rudder 26 powered by the engine to propel and steer the boat, comprising: a steering wheel 28 installed near a seat of an operator of the boat to be manipulated by the operator; a steering angle sensor 30 installed near the steering wheel for outputting a signal indicative of a steering angle of the steering wheel; a swivel shaft 50 connected to the propeller to turn the propeller relative to the boat; an actuator (electric motor 44) connected to the swivel shaft for rotating the swivel shaft in response to the detected steering angle; and a manipulation load regulation mechanism capable of producing an added load for increasing a manipulation load experienced at the steering wheel by the operator.

In the system, the manipulation load regulation mechanism comprises a hydraulic damper 66 connected to the steering wheel for increasing the manipulation load of the steering wheel 28.

Optionally, the system further includes: a manual adjuster (66*m*) to be operable by the operator such that the added load can be adjusted by the operator.

In the system, the hydraulic damper may comprise; a vane 66*b* connected to the steering wheel and housed in oil-filled chambers 66*a*1, 66*a*2; and an oil passage 66*c*, 66*f* communicating the chambers, wherein flow resistance in the oil passage increases a manipulation load of the vane to produce the added load for increasing the manipulation load of the steering wheel.

The system may further include; a manual adjuster comprising a manual valve 66*m* provided at an orifice 66*e* installed at the oil passage to regulate the opening area of the orifice such that the manipulation load can be adjusted.

The system may also further include; a solenoid valve 66*o* installed at the oil passage to regulate the opening area of the oil passage; and a manual adjuster comprising a load selector switch 72 being manually operable by the operator to select one of positions to regulate an opening of the oil passage such that the manipulation load can be adjusted.

The system may further include; a solenoid controller 70 supplying a voltage to the solenoid valve corresponding to the selected switch position to regulate an opening of the oil passage such that the manipulation load can be adjusted.

In the system, the manipulation load regulation mechanism may comprise an electric brake (electric motor 80).

The system may further include: a manual adjuster (load selector switch 72) to be operable by the operator such that the added load can be adjusted by the operator.

In the system, where used, the electric brake may comprise; an electric motor 80 connected to the steering wheel 28; and a motor controller 82 controlling operation of the electric motor to rotate in a direction opposite to a direction in which the steering wheel is manipulated, so as to increase the manipulation load of the steering wheel.

In the system, the electric brake may comprise: an electric motor 80 connected to the steering wheel 28; a manual adjuster comprising a load selector switch 72 being manually operable by the operator to select one of positions; and a motor controller 82 supplying a voltage to the electric motor corresponding to the selected switch position such that the manipulation load can be adjusted.

In the system, the manipulation load regulation mechanism may comprise a friction brake.

The system may further include: a manual adjuster (grid 100*c*) to be operable by the operator such that the added load can be adjusted by the operator.

In the system, the friction brake may comprise; a disk 100*a* connected to the steering wheel; and a brake pad 100*b* to be pressed onto the disk to produce a mechanical friction produced therebetween, so as to increase the manipulation load of the steering wheel.

The system may further include; a manual adjuster comprising a grid 100*c* connected to the brake pad and being manually operable by the operator to vary a pressure of the brake pad onto the disk such that the manipulation load can be adjusted.

The system may also further include: a sensor (crank/angle sensor 90) for detecting a parameter indicative of a speed of the boat; and a manipulation load changer for changing the manipulation load based on the detected parameter.

While the invention has thus been shown and described with reference to specific embodiments, it should be noted that the invention is in no way limited to the details of the described arrangements; changes and modifications may be made without departing from the scope of the appended claims.

What is claimed is:

1. A steering system for an outboard motor mounted on a stem of a boat and having an internal combustion engine and a propeller with a rudder powered by the engine to propel and steer the boat, said steering system comprising:

a steering wheel installed near a seat for an operator of the boat, said steering wheel provided to be manipulated by the operator;

a steering angle sensor installed near the steering wheel for outputting a signal indicative of a detected steering angle of the steering wheel;

a swivel shaft connected to the propeller for turning the propeller relative to the boat;

an actuator connected to the swivel shaft for rotating the swivel shaft in response to the detected steering angle; and a manipulation load regulation mechanism capable of producing an added load for increasing a manipulation load experienced at the steering wheel by the operator;

wherein the manipulation load regulation mechanism comprises a hydraulic damper operatively connected to the steering wheel, for increasing the manipulation load of the steering wheel.

2. The steering system according to claim 1, further including:

a manual adjuster operable by the operator such that the added load can be adjusted by the operator.

3. The steering system according to claim 1, wherein the hydraulic damper comprises:

a housing having a hollow chamber formed therein, wherein the chamber is substantially filled with oil to provide an oil-filled chamber;

a vane operatively connected to the steering wheel and housed in the oil-filled chamber, the vane operating as a partition to divide the oil-filled chamber into two chambers; and an oil passage formed in the housing and communicating between the chambers, wherein flow resistance in the oil passage increases a manipulation load of the vane to produce the added load for increasing the manipulation load of the steering wheel.

4. The steering system according to claim 3, further including:

a manual adjuster comprising a manual valve provided at an orifice installed at the oil passage to regulate the opening area of the orifice such that the manipulation load can be adjusted.

5. The steering system according to claim 3, further including;

a solenoid valve installed at the oil passage to regulate the opening area of the oil passage; and a manual adjuster comprising a load selector switch being manually operable by the operator to select one of a plurality of positions to regulate an opening of the oil passage such that the manipulation load can be adjusted.

6. The steering system according to claim 5, further including:

a solenoid controller supplying a voltage, corresponding to the selected switch position, to the solenoid valve to regulate an opening of the oil passage, such that the manipulation load can be adjusted.

7. The steering system according to claim 1, further including:

a speed sensor for detecting a parameter indicative of a speed of the boat; and a manipulation load changer for changing the manipulation load based on the detected parameter.

8. A steering system for an outboard motor mounted on a stem of a boat and having an internal combustion engine and a propeller with a rudder powered by the engine to propel and steer the boat, said steering system comprising:

a steering wheel installed near a seat for an operator of the boat, said steering wheel provided to be manipulated by the operator;

a steering angle sensor installed near the steering wheel for outputting a signal indicative of a detected steering angle of the steering wheel;

a swivel shaft connected to the propeller to turn the propeller relative to the boat;

an actuator connected to the swivel shaft for rotating the swivel shaft in response to the detected steering angle;

a manipulation load regulation mechanism capable of producing an added load for increasing a manipulation load experienced at the steering wheel by the operator; and a manual adjuster operable by the operator such that the added load can be adjusted by the operator;

wherein the manipulation load regulation mechanism comprises an electric brake.

9. The steering system according to claim 8, wherein the electric brake comprises:

an electric motor operatively connected to the steering wheel; and a motor controller for controlling operation of the electric motor, wherein the motor controller is operable to rotate the motor in a direction opposite to a direction in which the steering wheel is manipulated, so as to increase the manipulation load of the steering wheel.

10. The steering system according to claim 8, wherein the electric brake comprises:

an electric motor operatively connected to the steering wheel;

a manual adjuster comprising a load selector switch being manually operable by the operator to select one of a plurality of positions; and a motor controller for supplying a voltage to the electric motor corresponding to the selected switch position, such that the manipulation load can be adjusted.

11. A steering system for an outboard motor mounted on a stem of a boat and having an internal combustion engine and a propeller with a rudder powered by the engine to propel and steer the boat, said steering system comprising:

a steering wheel installed near a seat for an operator of the boat, said steering wheel provided to be manipulated by the operator;

a steering angle sensor installed near the steering wheel for outputting a signal indicative of a detected steering angle of the steering wheel;

a swivel shaft connected to the propeller to turn the propeller relative to the boat;

an actuator connected to the swivel shaft for rotating the swivel shaft in response to the detected steering angle;

a manipulation load regulation mechanism capable of producing an added load for increasing a manipulation load experienced at the steering wheel by the operator; and a manual adjuster operable by the operator such that the added load can be adjusted by the operator;

wherein the manipulation load regulation mechanism comprises a friction brake.

12. The steering system according to claim 11, wherein the friction brake comprises:

a disk connected to the steering wheel; and a brake pad adapted to be selectively pressed onto the disk to produce a mechanical friction therebetween, so as to increase the manipulation load of the steering wheel.

13. The steering system according to claim 12, further including:

a manual adjuster comprising a grid connected to the brake pad and being manually operable by the operator to vary a pressure of the brake pad onto the disk such that the manipulation load can be adjusted.

14. The steering system according to claim 11, further including:

a speed sensor for detecting a parameter indicative of a speed of the boat; and a manipulation load changer for changing the manipulation load based on the detected parameter.

15. A steering system for an outboard motor mounted on a stem of a boat and having an internal combustion engine and a propeller with a rudder powered by the engine to propel and steer the boat, said steering system comprising:

a steering wheel installed near a seat for an operator of the boat, said steering wheel provided to be manipulated by the operator;

a steering angle sensor installed near the steering wheel for outputting a signal indicative of a detected steering angle of the steering wheel;

a swivel shaft connected to the propeller to turn the propeller relative to the boat;

an actuator connected to the swivel shaft for rotating the swivel shaft in response to the detected steering angle;

a manipulation load regulation mechanism capable of producing an added load for increasing a manipulation load experienced at the steering wheel by the operator;

a speed sensor for detecting a parameter indicative of a speed of the boat; and a manipulation load changer for changing the manipulation load based on the detected parameter;

wherein the manipulation load regulation mechanism comprises an electric brake.

* * * * *

UNITED STATES PATENT AND TRADEMARK OFFICE

CERTIFICATE OF CORRECTION

PATENT NO. : 7,263,943 B2
APPLICATION NO. : 11/118948
DATED : September 4, 2007
INVENTOR(S) : Hideaki Takada et al.

It is certified that error appears in the above-identified patent and that said Letters Patent is hereby corrected as shown below:

What is claimed is:

Column 12, Claim 1, line 2:
Change "stem" to -- stern --

Column 13, Claim 8, line 2:
Change "stem" to -- stern --

Column 14, Claim 11, line 2:
Change "stem" to -- stern --

Column 15, Claim 15, line 2:
Change "stem" to -- stern --

Signed and Sealed this

Eleventh Day of December, 2007

JON W. DUDAS
*Director of the United States Patent and Trademark Office*